United States Patent [19]

Parker

[11] Patent Number: 4,526,307

[45] Date of Patent: Jul. 2, 1985

[54] PORTABLE COMBINATION TENT AND BACKPACK

[76] Inventor: Ronald J. Parker, 758 E. Railroad St., Columbia Falls, Mont. 59912

[21] Appl. No.: 628,422

[22] Filed: Jul. 6, 1984

[51] Int. Cl.[3] ..... A45F 4/04

[52] U.S. Cl. ..... 224/154; 135/95

[58] Field of Search ..... 224/154–156; 135/90, 95, 102

[56] References Cited

U.S. PATENT DOCUMENTS

| | | | |
|---|---|---|---|
| 39,150 | 7/1863 | Joubert | 224/156 X |
| 41,418 | 2/1864 | Abbott . | |
| 748,288 | 12/1903 | Klein | 224/156 |
| 979,037 | 12/1910 | Searle . | |
| 1,048,806 | 12/1912 | Burch . | |
| 1,198,773 | 9/1916 | Robinson | 224/154 |
| 1,464,875 | 8/1923 | Hull et al. . | |
| 1,541,060 | 6/1925 | Martin | 224/156 |
| 3,116,808 | 1/1964 | Riley . | |
| 3,545,461 | 12/1970 | Carlson . | |
| 3,730,407 | 5/1973 | Russell . | |
| 3,757,360 | 11/1973 | Wescott | 224/154 X |
| 3,931,918 | 1/1976 | Smith et al. | 224/154 |
| 3,971,495 | 7/1976 | Velazquez | 224/154 |
| 4,077,418 | 3/1978 | Cohen | 224/154 X |
| 4,239,135 | 12/1980 | Armstrong | 224/154 |
| 4,251,015 | 2/1981 | Gale, Jr. . | |
| 4,331,272 | 5/1982 | Ward | 224/154 |

*Primary Examiner*—Stephen Marcus
*Assistant Examiner*—Robert Petrik
*Attorney, Agent, or Firm*—Wells, St. John & Roberts

[57] ABSTRACT

A combination tent and backpack. In the tent mode of operation, the tent is assembled with a floor framework having two or more framework pieces which are connected together. The floor framework is assembled within an envelope or other structure which surrounds and holds the floor framework together. The floor framework also acts as a supporting layer upon which the person and his gear rest. The floor framework is suspended from a tree or other supporting structure using a plurality of suspension lines which extend from a common connection point to points about the floor framework. A tent shroud can be installed over the suspension lines and tent floor to provide waterproof cover. In the backpack mode of operation the envelope is folded. Shoulder straps are drawn from the back of the backpack, up and over and through slip-fittings and then about the shoulders of the individual to be finally connected to the front of the backpack at a point near the wearer's waist.

11 Claims, 11 Drawing Figures

FIG 7
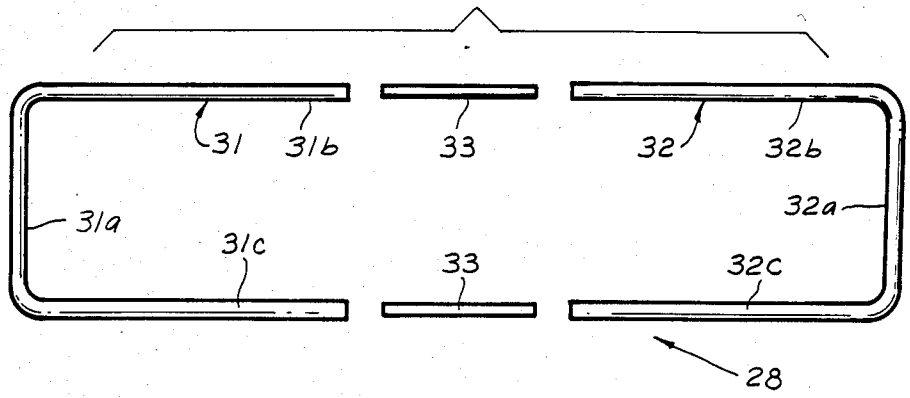
FIG 8
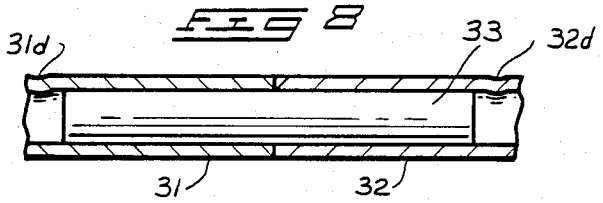
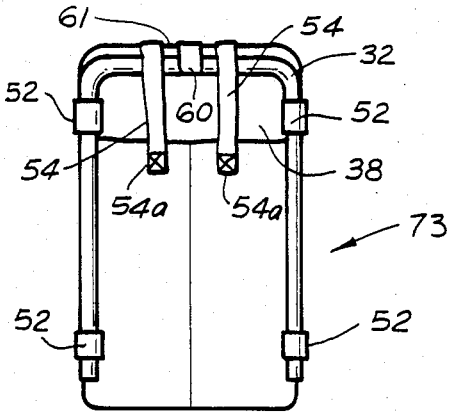
FIG 9
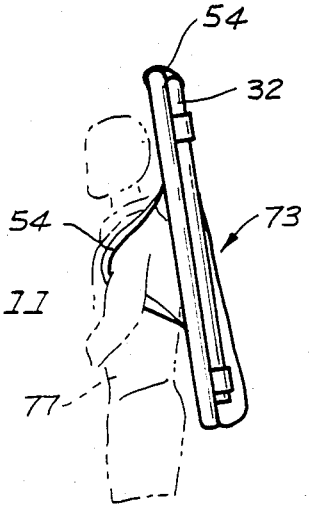
FIG 11
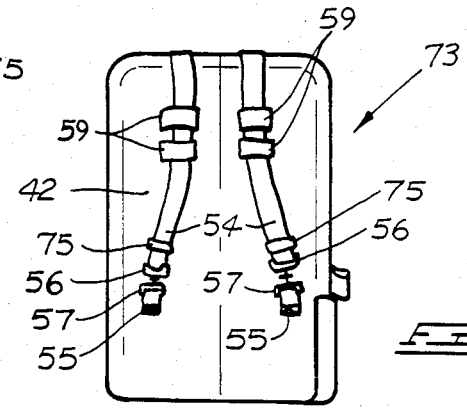
FIG 10

PORTABLE COMBINATION TENT AND BACKPACK

TECHNICAL FIELD

The technical field of this invention is portable combination tents and backpacks.

BACKGROUND OF THE INVENTION

The sport of backpacking has become increasingly popular. Its popularity has led to development of a wide variety of gear specifically designed to reduce the overall weight of the backpacker's load, which in many cases must be carried over long distances.

It is now typical for a backpacker to use a backpack for carrying gear including a portable tent which is erected upon the ground. Use of ground supported tents requires that the tent either have a waterproof floor or that it be used on a ground cloth to prevent rain or dampness from migrating into the tent and hence into the camper's other gear. Current use of a separate backpack and tent requires that the tent and backpack each incorporate their own independent frame systems to properly support the backpack and tent when in use.

One limitation with typical prior art tents used in backpacking is their inability to be suspended from a tree or other supporting structure. Being able to suspend a tent has several advantages. Firstly, a tent suspended from a tree need not incorporate a waterproof floor since the bottom of the tent is suspended in air, thereby preventing runoff from rainstorms and ground moisture from entering the tent. Suspending a tent from a tree also has the distinct advantage of allowing the camper to position the tent high enough in the tree to prevent or make difficult attack by wild animals such as bears, mountain lions, coyotes and smaller animals which might be inclined to attack either the human or the provisions stored in a tent.

It is an object of this invention to provide a portable tent structure which can be converted into a backpack which can be easily carried on the camper's back and which can carry camping gear in addition to the tent.

It is an object of this invention to provide a combination tent and backpack which can be suspended from trees or other supporting structures and which acts as a stand or cot for supporting persons suspended above the ground in relative comfort.

These and other objectives and advantages of the invention will be apparent from the description of the preferred embodiments given herein.

BRIEF DESCRIPTION OF THE DRAWINGS

The invention is illustrated in the accompanying drawings, in which:

FIG. 7 is an exploded view of the tent floor framework used in the tent floor of FIGS. 5 and 6;

FIG. 8 is an enlarged side sectional view of the joint connecting two floor framework halves together;

FIG. 9 is an elevational view of the rear side of the backpack formed from the portable tent of FIG. 1;

FIG. 10 is a front elevational view of the backpack shown in FIG. 9; and FIG. 11 is a side elevational view showing how the backpack of FIGS. 9 and 10 is worn on a camper's back.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
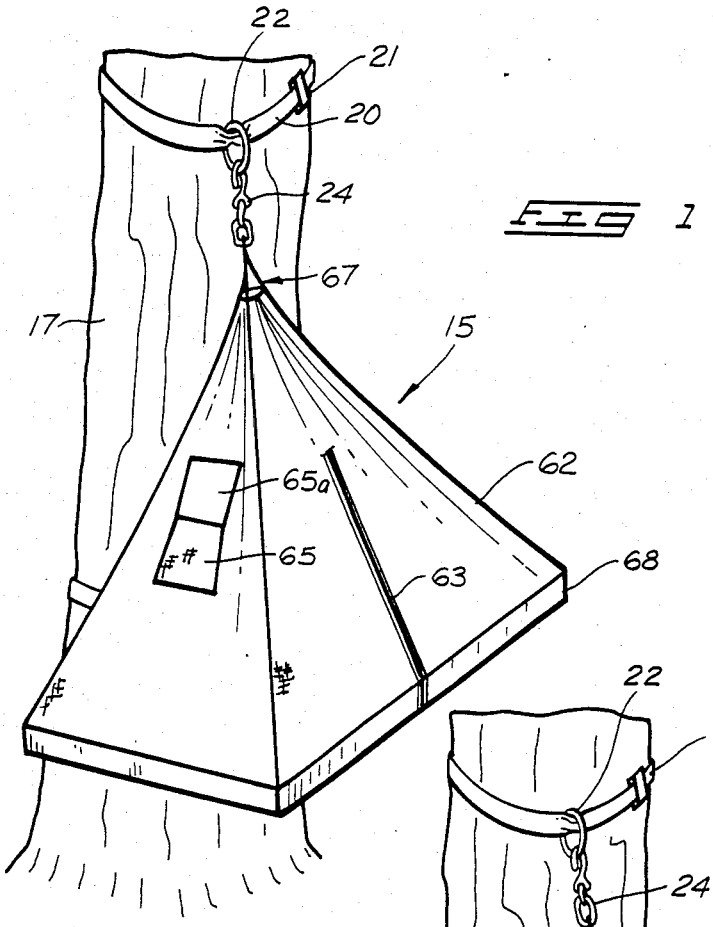
FIG. 1 is a perspective view showing a tent constructed with a preferred form of the invention suspended from a tree.

FIG. 1 shows a tent 15 which is formed using the preferred embodiment combination tent and backpack according to this invention. A tent 15 constructed using the preferred form of the invention includes a tent floor or stand 16 most clearly shown in FIG. 2. Tent floor 16 is suspended from a tree 17 using a suspension means 18.

Suspension means 18 preferably includes a flexible girth belt 20. Girth belt 20 is preferably a piece of flexible nylon belting material which is sufficiently long to extend about the girth of tree 17. Girth belt 20 can also be any one of a number of different types of girth belt means such as a cable, rope, chain or other suitable structure which extends about the tree and which is capable of supporting the tent and one or two persons sitting on the tent floor. Girth belt means 20 preferably includes a girth belt fastening means which allows two ends of the girth belt to be detached from one another so that the belt can be easily extended and fastened about the trunk of a tree.

Suspension means 18 also preferably includes a girth belt ring 22 which is preferably adjustably threaded onto girth belt 20. Girth belt ring 22 is preferably slidable upon girth belt 20 to allow the exact position of the tent 15 to be adjusted in conformance with contours of the tree trunk so that the tent can be positioned at a point which offers greatest stability.

Figure 2:
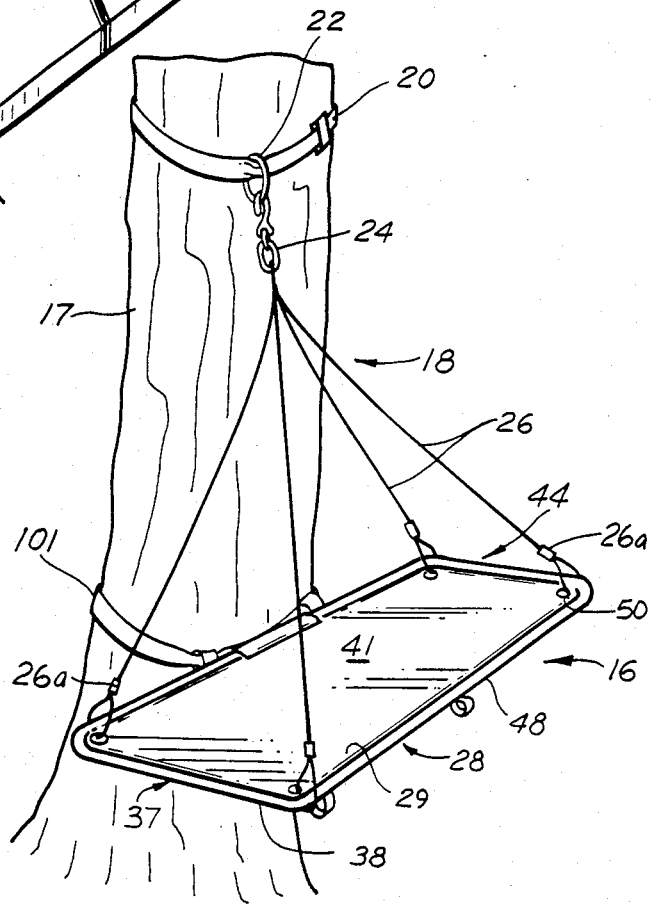
FIG. 2 is a perspective view of the tent shown in FIG. 1 with the tent shroud removed showing the tent floor and supporting suspension means.

Suspension means 18 advantageously includes suspension clasp means 24 which is preferably detachably connectable to girth belt ring 22. Suspension clasp means 24 can be either detachably or nondetachably connected to a plurality of suspension lines 26. In the preferred embodiment there are four suspension lines 26 which extend from an apex at clasp 24 to each of the four corners of the rectangularly shaped tent floor 16. It will be readily apparent that other numbers and configurations for suspension lines 26 are also possible. Suspension lines 26 are connected to the tent floor in any suitable manner, such as by extending the suspension lines around the structural framework of the tent floor and securely fastening the distal ends to their respective lines using fasteners **26*a* as shown in FIG. 2**.

Tent floor 16 is preferably constructed having a tent floor framework 28 and a floor-pack structure or envelope 29. Tent floor framework 28 is shown in FIG. 7 in exploded top view. Tent floor framework 28 includes a first framework half 31 and a second framework half 32. First and second framework halves 31 and 32 are preferably constructed in the same or similar size and shape. First and second framework halves 31 and 32 are preferably tubular members constructed from a strong lightweight material such as aluminum, magnesium, titanium or other suitable materials.

First and second framework pieces or halves 31 and 32 are each advantageously U-shaped for constructing a one man sized tent floor. The shape can also be varied for specific needs. The framework halves include midsections 31*a* and 32*a;* inside legs 31*b* and 32*b;* and outside legs 31*c* and 32*c.* When joined together the framework pieces define an elongated or approximately rectangular floor suitably sized to support a person when the person is lying flat thereon.

Tent floor framework 28 can be constructed in a variety of configurations but is preferably constructed with first and second framework halves 31 and 32 being joined by a frame connection means such as connection dowels or pieces 33 which are properly sized to just fit within the inside diameter of the tubular framework halves as illustrated in FIG. 8. Connection dowels 33 bridge between the ends of the first and second framework halves thereby supporting the bending moment which must be carried by the floor framework. Connection dowels 33 are preferably sufficiently long so that the loads imposed on the floor framework are evenly distributed between the connection dowel and the framework halves, thereby reducing or eliminating concentrated end effects. Connection dowels can be either circular or noncircular in cross-sectional shape.

Floor framework halves 31 and 32 are preferably provided with dowel stops 31*d* and 32*d* (FIG. 8) for limiting the extent to which connection dowels 33 can be inserted. Dowel stops 31*d* and 32*d* can advantageously be formed by indenting the framework halves at the appropriate location.

In a preferred embodiment each of connection dowels 33 is approximately one foot in length when the assembled tent floor framework measures approximately two feet in width by six feet in length. Connection dowels 33 are preferably constructed of a very strong hard lightweight material. Suitable materials would include a strong species of wood, fiberglass, metal and other possible materials of construction.

Figure 5:
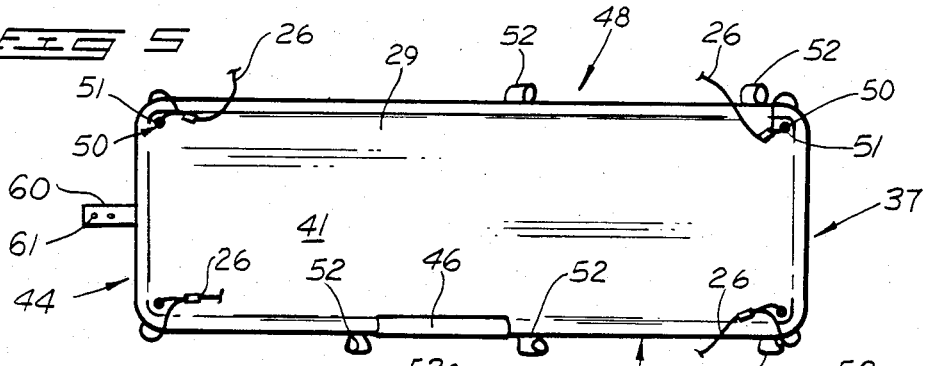
FIG. 5 is a top view of the tent floor shown in FIG. 2.

Tent floor 16 includes not only the tent floor framework 28 but also a floor-pack structure such as floor-pack envelope 29 which extends across tent floor framework 28 so as to provide a surface on which the person can stand, sit or lie. Floor-pack envelope 29 can be constructed in a number of suitable configurations. It is preferably an envelope having a bottom layer 41 and a top layer 42. The bottom and top layers are connected together about both sides 47 and 48 and at closed end 44. An assembled floor framework 28 can be slipped into the envelope through an opening 35 formed at an open end 37 of floor-pack envelope 29 (see FIGS. 5 and 6). Top layer 41 is preferably positioned upwardly as shown in FIG. 2 so that a person using the tent can sit, stand or lie upon the approximately horizontal surface formed by the envelope mounted on floor framework 28.

The open end of envelope 29 is preferably provided with a flap 38 which is folded over the midsection 32*a* of second framework half 32 when the assembled framework is inserted into the envelope. Flap 38 is advantageously an extension of top layer 41. Flap 38 is preferably provided with snaps or other fasteners 39 which securely hold the flap 38 in position to retain the floor framework in position. Flap 38 is also used when the invention is converted into a backpack as discussed below.

Sides 47 and 48 and closed end 44 of floor-pack envelope 29 are preferably formed by sewing the top and bottom layers 41 and 42 together along a seam or seams. Closed end 44 helps to hold the tent floor framework 28 in fixed position within the envelope 29. Floor-pack envelope 29 is also preferably provided with an abrasion resistant layer 46 along the inside edge 47 so as to prevent abrasion of envelope 29 where it contacts the tree truck 17. Outside edge 48 is normally positioned outwardly from the tree trunk as shown in FIG. 2.

Suspension lines 26 are preferably permanently installed in a loop about corner portions of envelope 29 and floor framework 28 using holes formed by grommets 51 mounted in both top and bottom layers 41 and 42. Suspension lines 26 looped about first floor framework half 31 hold that half in position within envelope 29.

Floor-pack envelope 29 advantageously includes a plurality of side loops 52 for supporting the second framework half 32 when made into the backpack shown in FIGS. 9 through 11. Side loop 52*a* is an accessory loop which can be used to receive a stabilizing belt 101 which can be extended about tree 17 and through loops 52 adjacent abrasion resistant layer 46.

Envelope 29 is also provided with accessories for enabling the envelope to function as an integral part of the backpack formed of this invention. Specifically, the bottom side 42 of envelope 29 can be provided with a pair of shoulder straps 54. Shoulder straps 54 are preferably sewn directly onto the bottom layer 42 at connection points 54*a*. Connection straps 54 are otherwise free from bottom layer 42, but can be joined to connection straps 55 in either of two modes of operation. In the first mode of operation the shoulder straps 54 are suspended beneath the bottom of envelope 29 and connected with connection straps 55 using mating connection pieces 56 and 57 which are attached to straps 54 and 55, respectively. This first mode of operation is used when the envelope is being used as a tent floor. In the second mode of operation the shoulder straps are extended in an opposite direction from connection points 54*a* over flap 38 and open end 37 of envelope 29. Connection pieces 56 are then inserted through shoulder strap slip fittings 59 and connected again to the mating connection strap connection pieces 57. The second mode operation is used when the invention is formed into a backpack as shown most clearly in FIGS. 9 and 10.

Floor-pack envelope 29 is advantageously provided with a tube loop 60 having a snap or other fastening means 61. Tube loop 60 is used to secure the midsection of second framework half 32 adjacent the first framework half 31 when the invention is being used in the backpack mode of operation (see FIGS. 9–11).

Figure 3:
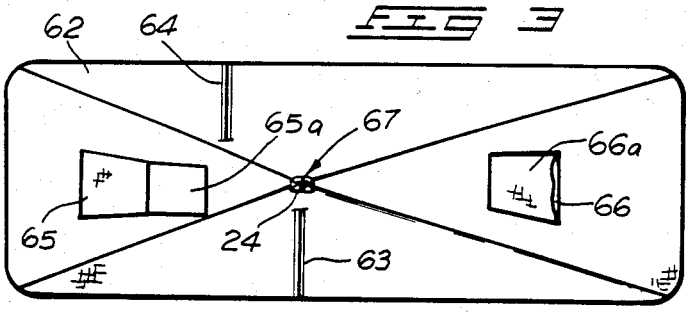
FIG. 3 is a top view of the tent of FIG. 1 shown in isolation from the tree.
Figure 4:
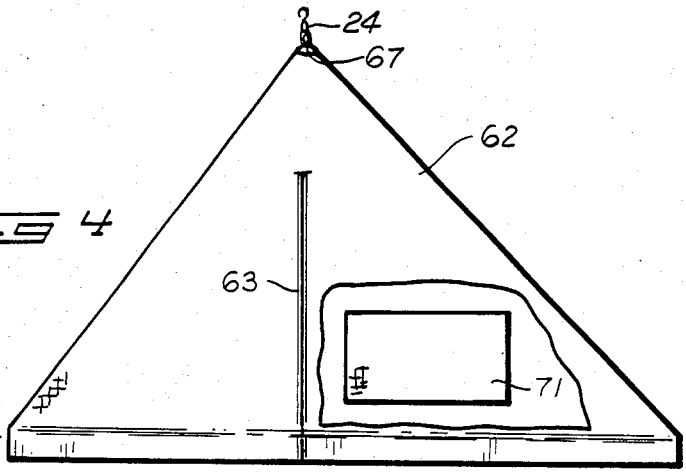
FIG. 4 is a front elevational view of the tent shown in FIG. 3, a portion is broken away to show the interior.

The combined tent and backpack of this invention can be provided either with or without the tent shroud 62 shown in FIGS. 1, 3 and 4. Tent shroud 62 is preferably constructed in a rectangular pyramidal shape slightly larger than the approximate pyramid shape defined by the suspension lines 26 when taut under the load of tent floor 16.

Tent shroud 62 preferably includes both a front opening 63 and a rear opening 64. Front opening 63 is advantageously positioned approximately in the middle of the front of the tent to provide basic access when the tent is hung in a relatively low position. Rear opening 64 is preferably provided in an offset position as best shown in FIG. 3, so that a person can climb the supporting tree and enter through rear opening 64 rather than having to contend with the opening at a point immediately next to the tree trunk. Openings 63 and 64 can be zippered or otherwise provided with a closure means as is well known in the art of tent manufacture.

Tent shroud 62 also preferably includes two windows 65 and 66 (see FIG. 3). Windows 65 and 66 are preferably provided with flaps 65*a* and 66*a* which can be secured up over the window openings for improved visibility and ventilation, using hook and loop type fastening material or other suitable means. Window flaps 65*a* and 66*a* can be also advantageously provided with means to secure them in covering positions over windows 65 and 66 during times of foul weather.

Tent shroud 62 preferably includes a bottom skirt 68 which extends down beyond the tent floor 16 approximately six inches, thereby assuring that wind-driven rain will not enter the interior of the tent. Tent shroud 62 is preferably constructed from a waterproof material or is coated with waterproofing so as to prevent leakage of water into the tent. It is also possible to provide a fly or other additional water covering (not shown) for the purpose of repelling water.

The manner of using the invention will now be described in greater detail. As indicated above, the combined tent and backpack of this invention can be used in at least two different modes of operation. In the tent mode of operation, the tent is assembled in a manner so as to hang from a tree 17 or other supporting structure. To assemble the tent upon the side of a tree or other supporting structure, it is first necessary to install the girth belt means 20 about the trunk of the tree or otherwise at an appropriate height above the ground. When comfort and ground water are the principal concerns, it may be desirable to install the girth belt at a point which places the tent floor approximately two feet off the surrounding ground. When wild animals are the principal concern, particularly when grizzly bears are near, then it may be necessary to install the girth belt at a point fifteen to twenty feet high in the tree. The girth belt is secured about the tree trunk using girth belt fastening means 21. Weight applied to one side of the girth belt will cock the belt on the tree trunk, thereby causing it to firmly engage the tree, but without damaging the tree bark.

Once girth belt 20 and attached girth belt ring 22 are installed on the tree trunk, it is then advisable to assemble the tree tent floor 16 and suspension means 18 together into an assembly such as shown in FIG. 2. Suspension lines 26 are normally permanently affixed through holes 50 in the envelope 29. The first floor framework half 31 is also similarly mounted within the envelope 29 and held in position by the corner loops of the suspension lines 26. Envelope 29 is opened at the open end 37 by unfolding flap 38 so that opening 35 is available. The person assembling the tent then installs the connection dowels in the open ends of first framework half 31. The second framework half 32 is then inserted through the opening 35 making sure that the inside leg 32*b* extends through the inside suspension line loop and the outside leg 32*c* extends through the outside suspension line loop. The ends of the second framework half 32 are then installed over the connections dowels 33 so that a complete tight connection as shown in FIG. 8 is made.

Figure 6:
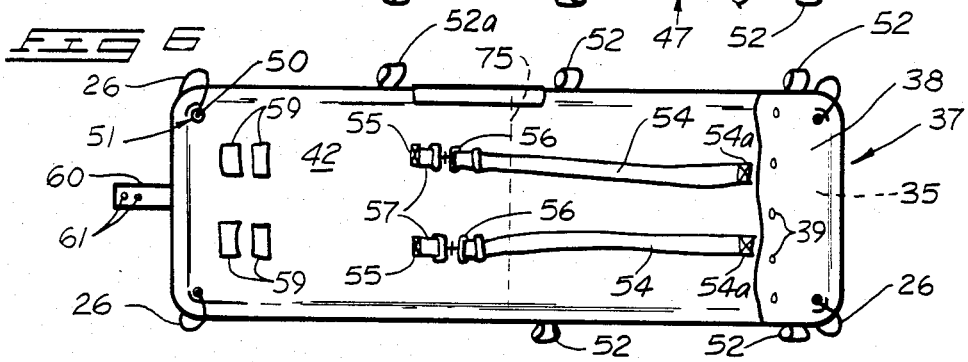
FIG. 6 is a bottom view of the tent floor shown in FIG. 5.

Envelope 29 is then secured over the floor framework by securing flap 38 into the position shown in FIG. 6 by attaching fastening means or snaps 39 so that the flap is secured to the bottom layer 42. The resulting tent floor 16 is then raised into position so that the suspension clasp means 24 can be secured to girth belt ring 22. The tent floor 16 is oriented so that the abrasion resistant layer 46 is adjacent to the tree. A stablizing belt 101 can also be extended about the tree at an elevation approximately the same as the tent floor. The stabilizing belt can be extended through auxiliary side loop 52*a* and an adjacent side loop 52 and drawn tight against the tree to prevent the tent floor from swaying.

Once the tent floor 16 and suspension means 18 have been secured in the tree or other supporting structure, it is then possible to sleep, sit or stand on the tent floor either with or without the tent shroud 62 installed. If the tent shroud 62 is desired for protection against wind or rain, then it is desirable to feed the tent shroud 62 over the assembled suspension means 18 and tent floor 16 prior to hanging the assembly from girth belt ring 22. Tent shroud 62 is provided with a top opening 67 which can be threaded over the clasp 24, thereby fixing the top of the tent at a point near clasp 24. The remaining shroud is shifted into position upon the suspension means and tent floor as indicated in FIGS. 1, 3 and 4. With the shroud properly in place it is then possible for a person to eat, sleep or sit in the tent. Entrance or exit can be gained by using either front or rear openings 63 or 64. The tent shroud can also advantageously be provided with an inside pocket 71 (see FIG. 4) which can be used to hold provisions or other gear while the person is present inside the tent.

The tree tent is dismantled by going through the operations just described in reverse order. Once the various components are removed from the tree or other supporting structure, it is then possible to arrange them together into the backpack 73 shown in FIGS. 9–11. In the backpacking mode of operation the tent shroud 62 is removed from the tent floor and is folded up into an appropriate size for storage in backpack 73. To construct backpack 73 it is necessary to open flap 38 and to disconnect the second floor framework half 32 from the first floor framework half 31. Connection dowels 33 are removed for independent storage.

Once the second framework half 32 has been removed from envelope 29 it is then possible to fold the envelope 29 about a fold line 75 indicated in FIG. 6. Envelope 29 is folded at fold line 75 so that the bottom layer 42 remains on the outside and the top layer 41 is folded inwardly. The second floor framework half 32 is installed within side loops 52 as shown most clearly in FIG. 9. Various camping gear and the connection dowels 33 are then stored within envelope 29 using opening 35. After all gear is installed within envelope 29, the flap 38 is then fastened shut and the shoulder belts 54 are extended upwardly from connection points 54*a* over the frame half 32 and frame half 31 (enclosed within envelope 29). Shoulder straps then extend downwardly along the front of the backpack and through the shoulder strap slip fittings 59 (FIG. 10). Shoulder straps 54 can then be connected using mating connection pieces 56 and 57 to form a shoulder harness means. Adjustment means such as belt adjustment loops 75 can also be provided so that the backpack can be adjusted to properly fit the wearer's body. FIG. 11 shows the backpack 73 installed upon the shoulders and back of a person 77 shown in phantom. Shoulder straps 54 extend downwardly from shoulder strap slip fittings 59 about and under the arms of the wearer.

In addition to the gear which can be stored within envelope 29, it is also possible to store large items at a point between the folded halves of the backpack between the opposing faces of top layer 41. Large items, such as sleeping bags, tent shroud 62, coats and other large items can be stored therebetween without significant risk they will be lost.

The combination tent and backpack of this invention is preferably constructed of the materials indicated above or other suitable substitutes as are well known in the art. The manner of making the invention will be readily apparent to those of ordinary skill in the art from the above description.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A combination suspension tent and backpack, comprising:

a plurality of framework pieces adapted for connection together;

frame connection means for connecting the framework pieces together to form a tent floor framework;

a tubular floor-pack envelope having a top layer and a bottom layer which are connected together along at least portions of an outside edge and inside edge to define an interior therebetween; the floor-pack envelope further having at least one open end through which framework pieces can be inserted and assembled within the floor pack envelope to form a tent floor therewith; said floor-pack envelope further forming an enclosure in which gear can be stored when the combination suspension tent and backpack is being used as a backpack;

shoulder harness means attachable to said floor-pack envelope upon exterior surfaces thereof for enabling the combination suspension tent and backpack to be carried upon the back and shoulders of a person and used to carry gear; within said interior of the floor pack envelope; and suspension means connectible to the floor framework for suspending the floor framework, attached floor-pack envelope and any supported load from a supporting structure.

2. The combination suspension tent and backpack of claim 1 further defined by said floor-pack envelope being closed along said outside edge, inside edge, and at a closed end thereof.

3. The combination suspension tent and backpack of claim 2 wherein the floor-pack envelope is provided with securable flap means for covering said open end.

4. The combination suspension tent and backpack of claim 1 wherein the framework pieces are two tubular U-shaped pieces sized to mate at open ends thereof, and the frame connection means are connection dowels which extend into open ends of the mating tubular U-shaped pieces.

5. The combination suspension tent and backpack of claim 1 further comprising a tent shroud which is installed above the tent floor upon the suspension means for protecting people or gear positioned thereon.

6. The conbination suspension tent and backpack of claim 1 wherein the suspension means comprises at least four lines connected to the floor framework near corners thereof and extending upwardly to form an apex whereat the cables are connected to a connection strap extended about a supporting structure from which the combination suspension tent and backpack is suspended.

7. The combined suspension tent and backpack of claim 6 further comprising a stabilizing belt connectible to the floor framework and connectible to the supporting structure to prevent lateral motion of the tent floor.

8. A combined suspension tent and backpack, comprising:

two substantially U-shaped framework pieces of approximately equal size and shape adapted for connection together at open ends thereof;

frame connection means for connecting open ends of said U-shaped framework pieces together to form a substantially planar tent floor framework;

a tubular, flexible floor-pack envelope having a top layer and bottom layer which are connected together along at least portions of an outside edge and an inside edge and defining an interior between said edges and the top and bottom layer; the floor-pack envelope having at least one open end through which framework pieces can be inserted into said interior and assembled into said tent floor framework to support the floor-pack envelope thereover;

a plurality of suspension lines connectible to the tent floor framework and extendible upwardly to jointly connect at an apex;

a suspension belt for connecting to a supporting structure;

means for connecting the plurality of suspension lines to said suspension belt;

a tent shroud adapted to be installed and supported upon said suspension lines for covering the tent floor framework and attached floor-pack envelope;

shoulder harness means attachable to exterior surfaces of said bottom layer of the floor-pack envelope whereby the floor-pack envelope, disassembled framework pieces, and any gear can be conveniently carried upon the back and shoulders of a person.

9. The combined suspension tent and backpack of claim 8 wherein the floor pack envelope is provided with at least one flap means to detachably cover an open end thereof, thereby allowing access to said interior for assembly of the tent floor framework and for storage of gear in the interior when used as a backpack.

10. The combined suspension tent and backpack of claim 9 wherein the shoulder harness means comprises shoulder straps attached to exterior surfaces of the bottom layer adjacent an open end and the flap detachably covering thereover; and further comprising connection straps connected to exterior surfaces of the bottom layer adjacent to a medial fold line.

11. The combined suspension tent and backpack of claim 8 further comprising a stabilizing belt extendable about a supporting structure, and wherein the floor-pack envelope is adapted to connect to said stabilizing belt to prevent lateral motion of the tent when suspended.

* * * * *